US007644721B2

(12) United States Patent
Hoberman et al.

(10) Patent No.: US 7,644,721 B2
(45) Date of Patent: Jan. 12, 2010

(54) SYNCHRONIZED FOUR-BAR LINKAGES

(75) Inventors: Charles Hoberman, 472 Greenwich St., New York, NY (US) 10013; Matthew Davis, Newtown, PA (US)

(73) Assignee: Charles Hoberman, New York, NY (US)

( * ) Notice: Subject to any disclaimer, the term of this patent is extended or adjusted under 35 U.S.C. 154(b) by 407 days.

(21) Appl. No.: 11/330,534

(22) Filed: Jan. 12, 2006

(65) Prior Publication Data

US 2006/0159868 A1 Jul. 20, 2006

Related U.S. Application Data

(60) Provisional application No. 60/644,233, filed on Jan. 14, 2005.

(51) Int. Cl.
*E04H 15/48* (2006.01)

(52) U.S. Cl. ..... 135/144; 135/123; 135/130; 135/152; 135/157; 52/79.5; 52/641

(58) Field of Classification Search ..... 135/121–123, 135/130–131, 135, 138, 143–146, 152, 157–159; 52/80.1–80.2, 81.2, 81.5, 63, 644, 641, 646, 52/652.1, 79.5; 74/490.01, 490.05; 248/280.1, 248/281.11, 274.1; 446/122–124
See application file for complete search history.

(56) References Cited

U.S. PATENT DOCUMENTS

| | | | | | |
|---|---|---|---|---|---|
| 746,210 | A | * | 12/1903 | Waite | 248/277.1 |
| 2,513,729 | A | * | 7/1950 | Lemen | 135/122 |
| 4,234,150 | A | * | 11/1980 | Mee et al. | 248/281.11 |
| 4,290,244 | A | | 9/1981 | Zeigler | |
| 4,311,338 | A | * | 1/1982 | Moorhouse | 297/411.36 |
| 4,942,700 | A | | 7/1990 | Hoberman | |
| 4,981,732 | A | | 1/1991 | Hoberman | |
| 5,024,031 | A | | 6/1991 | Hoberman | |
| 5,228,258 | A | * | 7/1993 | Onoda et al. | 52/646 |
| 5,234,727 | A | | 8/1993 | Hoberman | |
| 5,274,980 | A | | 1/1994 | Zeigler | |
| 5,651,228 | A | | 7/1997 | Zeigler | |
| 5,680,145 | A | * | 10/1997 | Thomson et al. | 343/915 |
| 6,082,056 | A | | 7/2000 | Hoberman | |
| 6,148,835 | A | * | 11/2000 | Rhee | 135/145 |
| 6,173,726 | B1 | * | 1/2001 | Talmadge | 135/144 |
| 6,190,231 | B1 | | 2/2001 | Hoberman | |
| 6,219,974 | B1 | | 4/2001 | Hoberman | |
| 6,313,811 | B1 | * | 11/2001 | Harless | 343/915 |
| 6,374,843 | B1 | * | 4/2002 | Zou | 135/145 |
| 6,578,593 | B2 | * | 6/2003 | Leonarz | 135/20.1 |
| 6,739,098 | B2 | | 5/2004 | Hoberman | |
| 6,834,465 | B2 | | 12/2004 | Hoberman | |
| 6,963,444 | B2 | * | 11/2005 | Brenner et al. | 359/384 |
| 7,178,612 | B2 | * | 2/2007 | Belik | 175/162 |
| 2002/0083675 | A1 | | 7/2002 | Hoberman | |
| 2002/0112413 | A1 | | 8/2002 | Hoberman | |
| 2004/0134157 | A1 | | 7/2004 | Hoberman | |
| 2005/0097832 | A1 | | 5/2005 | Hoberman | |

* cited by examiner

*Primary Examiner*—Winnie Yip
(74) *Attorney, Agent, or Firm*—Gottlieb, Rackman & Reisman

(57) ABSTRACT

A mechanism that is comprised of two or more four-bar linkages is shown. Each linkage shares a common link with each adjacent linkage and the movement of said two or more linkages is synchronized by mechanical means such that said mechanism may move between a collapsed and an extended state. Said mechanical means may be in the form of additional links or geared connections.

17 Claims, 15 Drawing Sheets

FIG.32
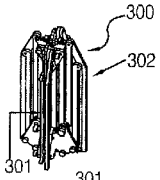
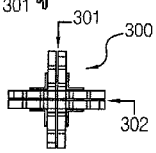
FIG.33
FIG.34
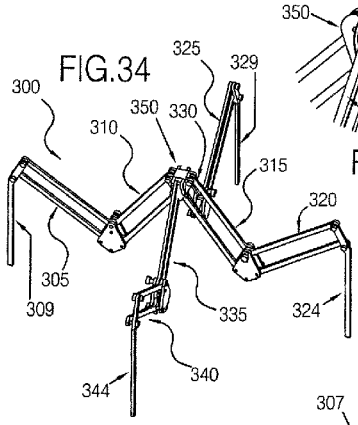
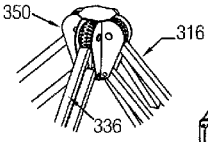
FIG.35
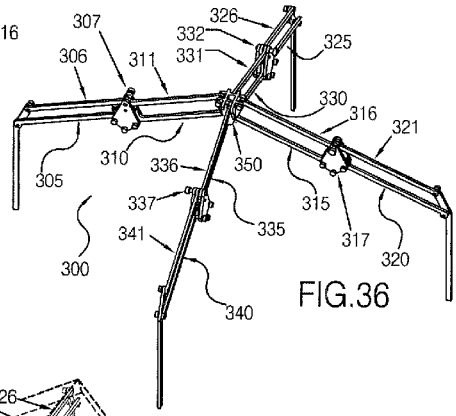
FIG.36
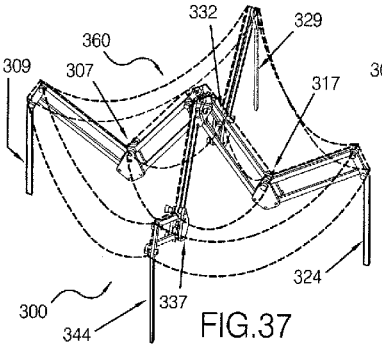
FIG.37
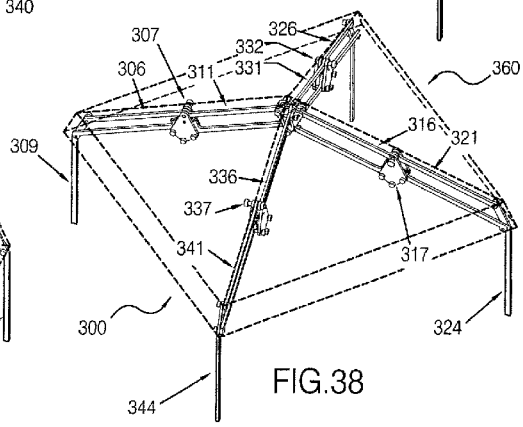
FIG.38
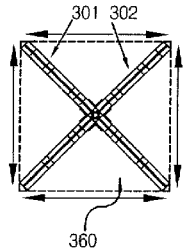
FIG.39

SYNCHRONIZED FOUR-BAR LINKAGES

The application claims priority benefit of Provisional Application No. 60/644,233, filed Jan. 14, 2005.

BACKGROUND OF THE INVENTION

This invention relates to the area of tents and the provision of temporary shelter. Often there is a need to rapidly set up such shelters. Among standard tent designs, the time required to set them up can be substantial. A series of steps is required including laying the fabric out on the ground, inserting and attaching poles, pulling the structure erect, staking it to the ground, and attaching guy ropes for extra stability. As the size of the tent or shelter increases, the required setup time lengthens.

There are various rapidly deployable systems for tents that effectively reduce the setup time. Many of these systems are based on extensible tong linkages, sometimes referred to as scissor linkages. My own U.S. Pat. No. 5,024,031, hereby incorporated by reference as if fully disclosed herein, utilizes such scissor linkages to construct transformable truss-structures in a variety of shapes.

Such scissor linkages are highly effective in creating structures that deploy or transform. However, once the structure is deployed, they are less effective in providing an optimum structural system. The "structural depth" of a scissor linkage varies widely. In some places, there is significant distance between its links while in other places, both links overlap such that there is no depth provided beyond the individual link dimensions. This results in a basic structural inefficiency. Such inefficiency can limit the structural span, lead to increased weight, and prevent efficient packaging.

We have discovered a method that solves these problems by creating a system that is equally adapted for optimum deployment as well as structural performance. This system is based on parallel four-bar linkages.

This invention relates to means of connecting series of four-bar linkages together such that they provide a structural truss in their extended state, provide a compact package in their retracted state, and move together in a synchronized fashion.

SUMMARY OF THE INVENTION

A mechanism is herein disclosed that is comprised of two or more four-bar linkages wherein each linkage shares a common link with each adjacent linkage and the movement of said two or more linkages is synchronized by mechanical means such that said mechanism may move between a collapsed and an extended state. Said mechanical means may be in the form of additional links or geared connections.

Further disclosed are means to cause the mechanism, when in its extended state, to become stiff and structural. Fabric elements may be attached to these mechanisms to form rapidly deployable shelters.

Accordingly, it is an object of the invention to provide a linkage system or mechanism that is adapted for optimum deployment and structural performance.

Another object of the invention is to provide a linkage system which provides a structural truss in its extended state.

A further object of the invention is to provide a linkage system which provides a compact package in its retracted state.

Still, other objects of the invention will, in part, be obvious and will, in part, be apparent from the following description.

BRIEF DESCRIPTION OF THE DRAWINGS

Reference is made to the following drawings in which:

FIG. 32 is a perspective view of a truss structure comprised of two linkage mechanisms of the invention;

FIG. 33 shows a plan view of the truss structure of FIG. 32;

FIG. 34 is a perspective view of the truss structure of FIG. 32 in a partially opened condition;

FIG. 35 is a detailed perspective view of hub element used in the truss structure of FIG. 32;

FIG. 36 is a perspective view that shows the truss structure of FIG. 32 in a fully opened condition;

FIG. 37 is a perspective view that shows the truss structure of FIG. 32 in a partially opened condition with a fabric element;

FIG. 38 is a perspective view that shows the truss structure of FIG. 32 in a fully opened condition with a fabric element held in a tensed and taut condition;

FIG. 39 is a plan view of the truss structure of FIG. 32 in a fully opened condition;

DETAILED DESCRIPTION OF THE INVENTION

Figures 1, 2, 3, 4, 5, 6:
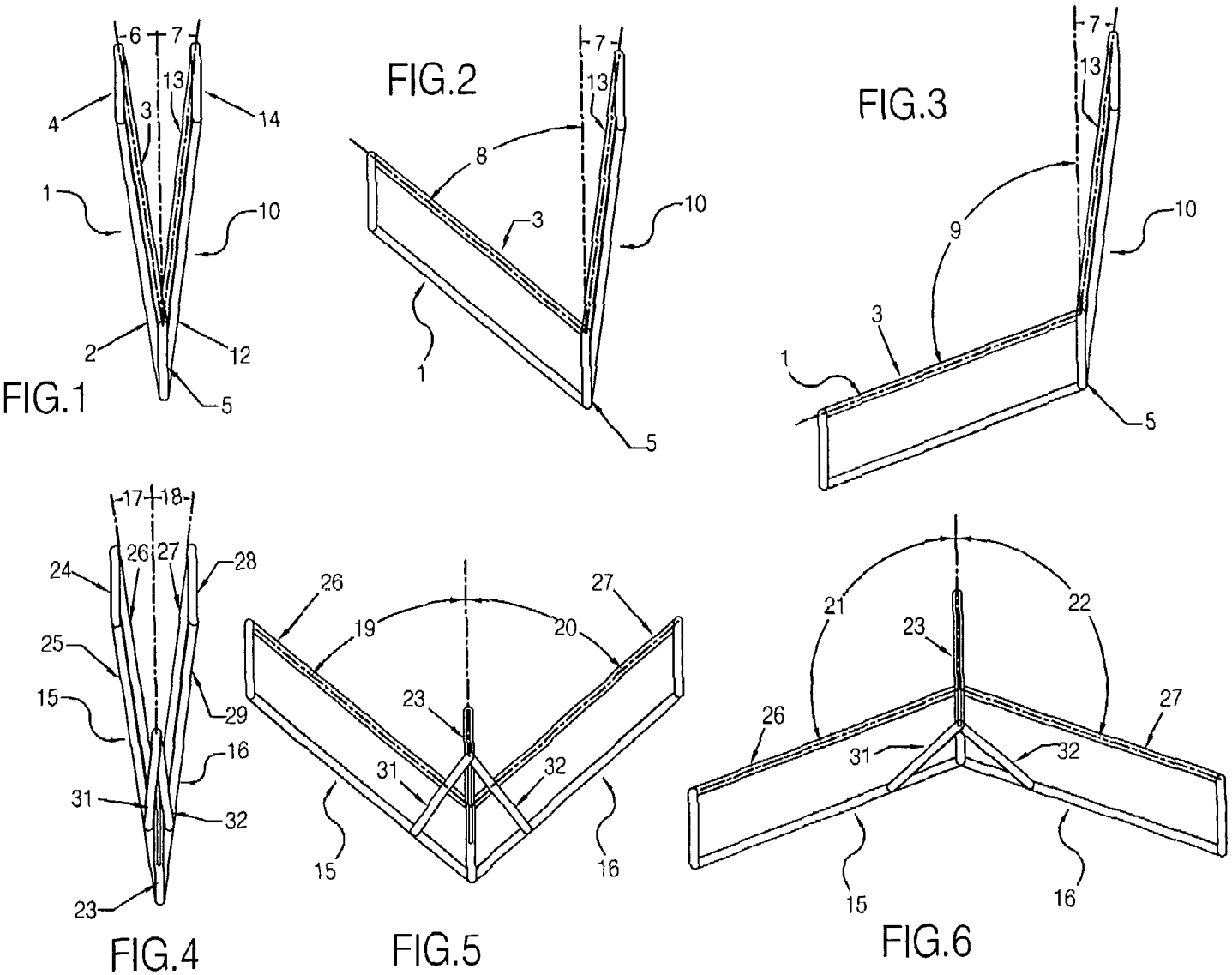
FIG. 1 is a front elevational view that shows two linkages of the inventive linkage mechanism.
FIG. 2 is a front elevational view that shows the linkages of FIG. 1 being rotated.
FIG. 3 is a front elevational view that shows the linkage mechanism of FIG. 1 in a further rotated position.
FIG. 4 is a front elevational view that shows a second embodiment of the inventive linkage mechanism.
FIG. 5 is a front elevational view that shows the linkages of FIG. 4 moved to a different position.
FIG. 6 is a front elevational view that shows the linkages of FIG. 4 moved to a third position.

FIG. 1 shows two linkages 1 and 10 that share a common link 5. Linkage 1 is comprised of four links 2, 3, 4 and 5; linkage 10 is comprised of four links 12, 13, 14 and 5. Linkages 1 and 10 are shown in a contracted position, such that links 3 and 13 form angles 6 and 7 relative to the centerline of common link 5.

FIG. 2 shows the linkages 1 and 10 whereby linkage 1 has been rotated such that the angle 8 formed by link 3 relative to common link 5 is now changed from the similarly formed angle shown in FIG. 1. Linkage 10 is shown to be in the same position as shown in FIG. 1. Therefore it may be seen that linkages 1 and 10 are capable of moving independently from each other.

FIG. 3 shows linkage 1 in a further rotated position, whereas linkage 10 is in the same position as the previous two figures.

FIG. 4 shows two linkages 15 and 16 that share a common link 23. In addition to the four links 23, 24, 25 and 26 that comprise linkage 15, an additional link 31 is shown pivotally attached to link 25 and having a sliding connection to link 23. In addition to the four links 23,27, 28 and 29 that comprise linkage 16, an additional link 32 is shown pivotally attached to link 29 and having a sliding connection to link 23. Linkages 15 and 16 are shown in a contracted position, such that links 26 and 27 form angles 17 and 18 relative to the centerline of common link 23.

FIG. 5 shows linkages 15 and 16 moved to different positions such that links 26 and 27 form angles 19 and 20 respectively relative to the centerline of link 23. In this case, links 31 and 32 ensure that the movement of linkage 15 is not independent of the movement of linkage 16; that is, both linkages move in a synchronized manner.

FIG. 6 shows linkages 15 and 16 moved to a third position such that that links 26 and 27 form angles 21 and 22 respectively relative to the centerline of link 23. Again, the movement of linkage 15 and 16 is synchronized by additional links 31 and 32.

Figure 7:
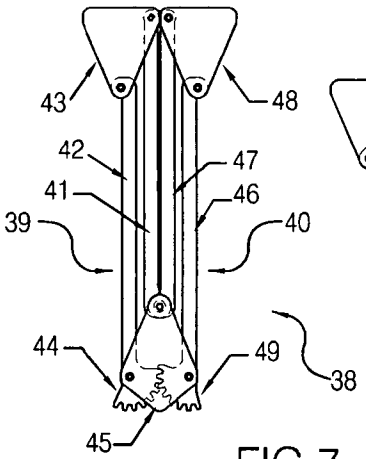
FIG. 7 is a front elevational view that shows a third embodiment of the inventive linkage mechanism.

FIG. 7 shows a mechanism 38 which is comprised of two linkages 39 and 40 sharing a common link 45. Linkage 39 is comprised of four links 41, 42, 43 and 45; linkage 40 is comprised of four links 47, 48, 49 and 45. Link 41 may be seen to be essentially parallel with link 47. Link 42 terminates at one end with a gear 44; link 46 terminates with gear 49. Gears 44 and 49 are engaged with each other. Gears 44 and 49 have equal pitch diameters, that is, are effectively the same size.

Figure 8:
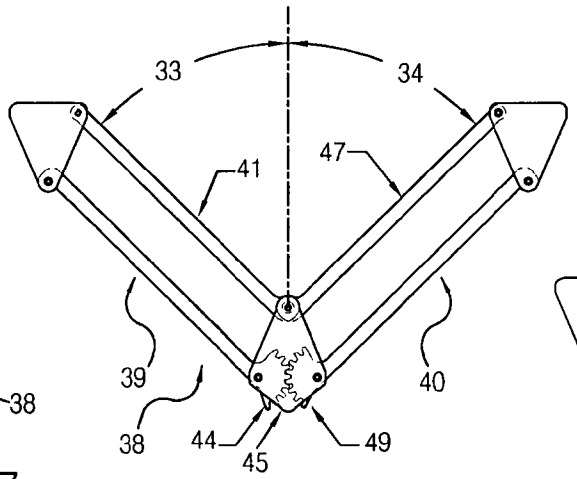
FIG. 8 is a front elevational view that shows the mechanism of FIG. 7 whereby the linkages have been rotated to a different position.

FIG. 8 shows mechanism 38 whereby linkages 39 and 40 have been rotated to a different position. Links 41 and 47 form angles 33 and 34 with the center line of common link 45. The movement of linkages 41 and 47 is synchronized by the engagement of gears 44 and 49. It may be seen that angles 33 and 34 are essentially equal: this equality is a result of the equal diameters of gears 44 and 49.

Figure 9:
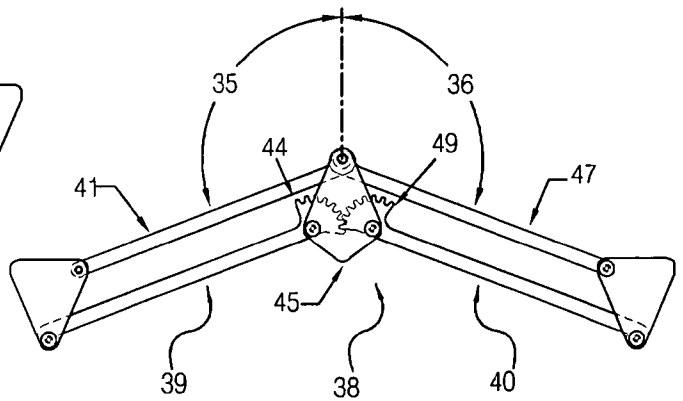
FIG. 9 is a front elevational view that shows the mechanism of FIG. 7 in a third position.

FIG. 9 shows mechanism 38 in a third position whereby links 41 and 47 form angles 35 and 36 with the center line of common link 45. Again angles 35 and 36 are essentially equal due to the equal diameters of gears 44 and 49.

Figure 10:
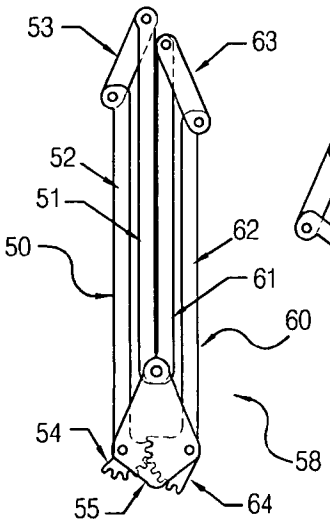
FIG. 10 is a front elevational view of a fourth embodiment of the inventive linkage mechanism.

FIG. 10 shows a mechanism 58 which is comprised of two linkages 50 and 60 sharing a common link 55. Linkage 50 is comprised of four links 51, 52, 53 and 55; linkage 60 is comprised of four links 61, 62, 63 and 55. Link 51 may be seen to be essentially parallel with link 61. Link 52 terminates on one end with a gear 54; link 62 terminates with gear 64. Gears 54 and 64 are engaged with each other. Gears 54 and 64 have unequal pitch diameters, gear 64 being larger than gear 54.

Figure 11:
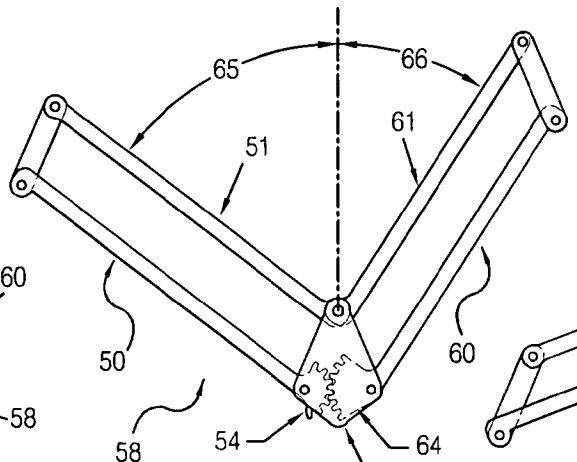
FIG. 11 is a front elevational view of the FIG. 10 linkage mechanism whereby the linkages have been rotated to a different position.

FIG. 11 shows mechanism 58 whereby linkages 50 and 60 have been rotated to a different position. Links 51 and 61 form angles 65 and 66 with the center line of common link 55. The movement of linkages 51 and 61 is synchronized by the engagement of gears 54 and 64. It may be seen that angle 65 is larger than angle 66 whereby he proportion of angle 65 to angle 66 is essentially equal to the proportion of diameters of gear 64 to gear 54. This common proportionality is the result of the synchronized rotation between the two gears.

Figure 12:
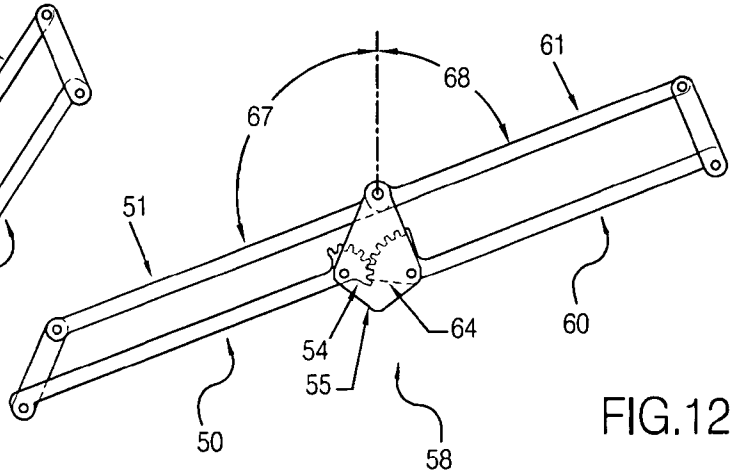
FIG. 12 is a front elevational view that shows the linkage mechanism of FIG. 10 in a third position.

FIG. 12 shows mechanism 58 in a third position whereby links 51 and 61 form angles 67 and 68 with the center line of common link 55. Again, the ratio between angles 67 and 68 is essentially equal to the ratio of diameters between gears 64 and 54.

Figure 13:
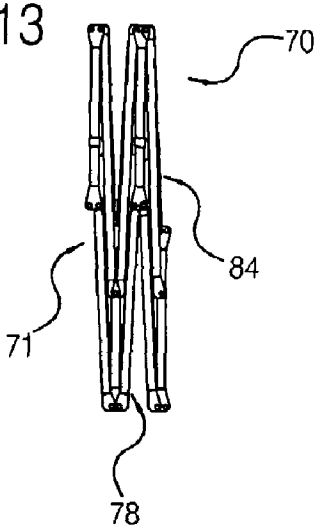
FIG. 13 is a front elevational view of a fifth embodiment of the inventive linkage mechanism in a collapsed condition.

FIG. 13 shows a mechanism 70 in a collapsed condition. Mechanism 70 is comprised of three linkages 71, 78 and 84.

Figure 14:
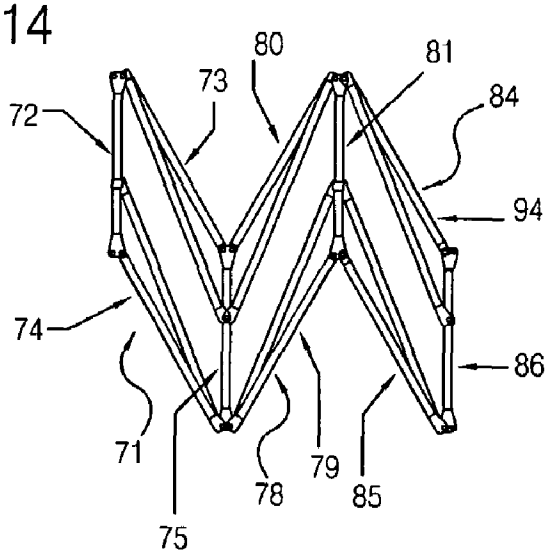
FIG. 14 is a front elevational view that shows the linkage mechanism of FIG. 13 in a partially opened condition.

FIG. 14 shows mechanism 70 in a partially opened condition. Linkage 71 is comprised in part of four links 72, 73, 74 and 75, each having a pivotal connection to its adjacent links. Similarly, linkage 78 is comprised in part of four links 79, 80, 81 and 75; linkage 84 is comprised in part of four links 85, 86, 94 and 81. Link 75 serves as a common link between linkages 71 and 78. Link 81 serves as a common link between linkages 78 and 84.

Figure 15:
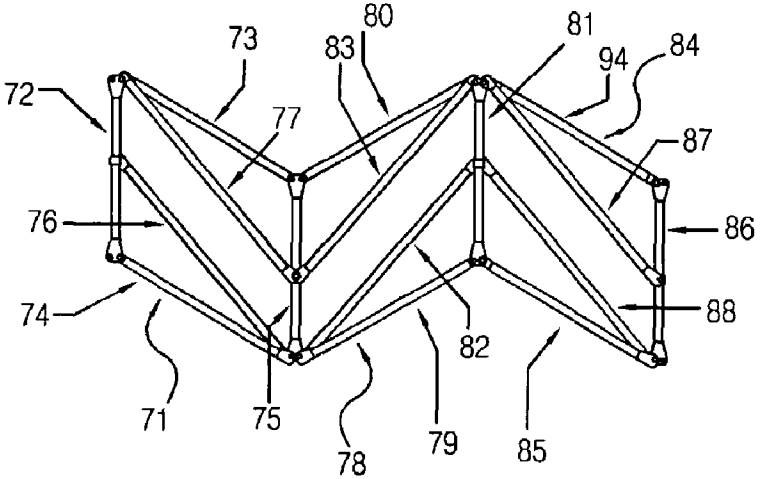
FIG. 15 is a front elevational view that shows the linkage mechanism of FIG. 13 in a further opened condition.

FIG. 15 shows mechanism 70 in a further opened condition. Linkage 71 is further comprised of links 76 and 77. Link 76 has a pivotal connection at one end to link 75. It has a sliding connection to link 72 at its other end. Link 77 has a pivotal connection to links 72 at one end; it has a sliding connection to link 75 at its other end.

Linkage 78 is further comprised of links 82 and 83. Links 82 and 83 have sliding connections to links 75 and 81 respectively. Linkage 84 is further comprised of links 87 and 88 which have sliding connections to links 86 and 81 respectively.

Figure 16:
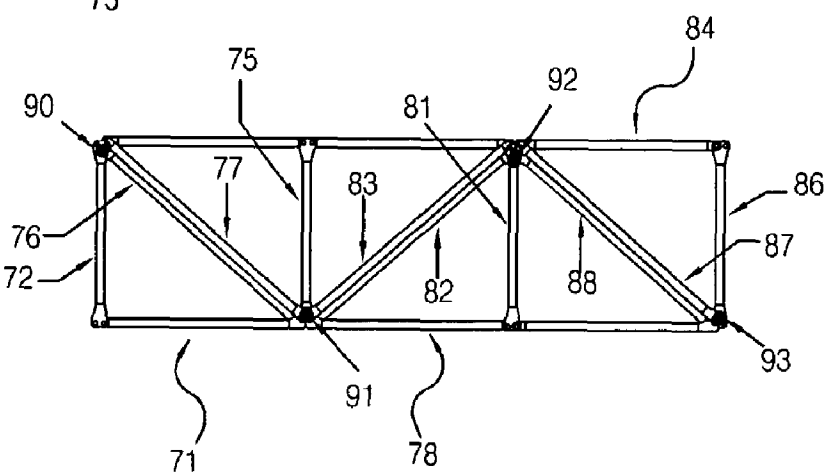
FIG. 16 is a front elevational view showing the linkage mechanism of FIG. 13 in a fully opened condition.

Mechanism 70 is shown in a fully opened condition in FIG. 16. Link 76 has been fixedly connected at its sliding end to link 72. This fixed connection is shown as attachment point 90. Link 77 has been fixedly connected at its sliding end to link 75 at attachment point 91. Likewise links 82 and 83 have been fixedly connected at their respective sliding ends to links 75 and 81 respectively at attachment points 91 and 92 respectively. Likewise links 87 and 88 have been fixedly connected at their respective sliding ends to links 81 and 86 respectively at attachment points 92 and 93 respectively.

Once sliding members 76, 77, 82, 83, 87 and 88 have been thus pinned, mechanism 70 forms a fully structural truss.

Figure 17:
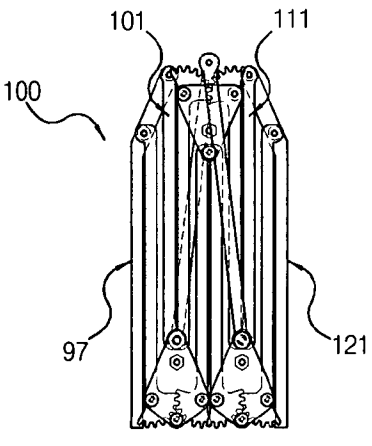
FIG. 17 is a front elevational view that shows a sixth embodiment of the inventive linkage mechanism.

FIG. 17 shows a mechanism 100 which is comprised of four linkages 97, 101, 111 and 121 in its folded condition.

Figure 18:
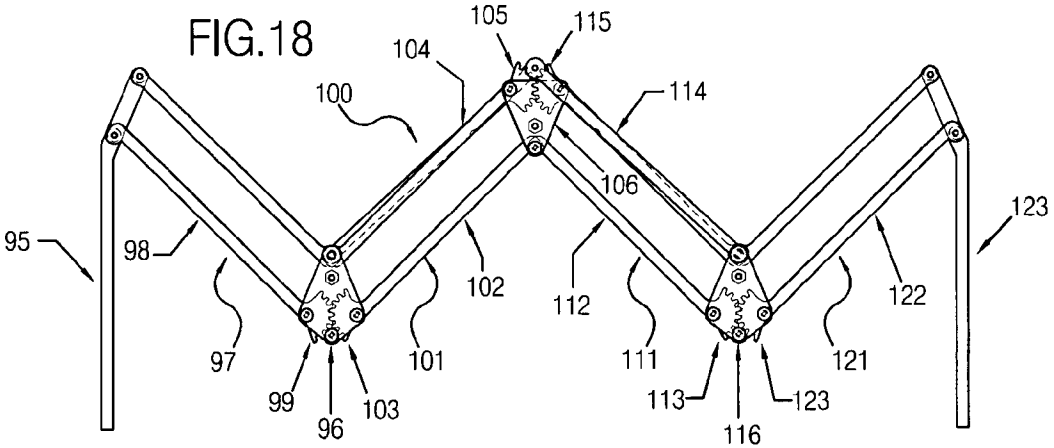
FIG. 18 is a front elevational view that shows the linkage mechanism of FIG. 17 in a partially opened condition.

FIG. 18 shows mechanism 100 in a partially opened condition. Linkages 97 and 101 share a common link 96. Linkages 101 and 111 share a common link 106. Linkages 111 and 121 share a common link 116. Link 95 belonging to linkage 97 has an extended length. Likewise link 123 belonging to linkage 121 has an extended length.

Links 98 and 102 are pivotally attached to common link 96. Link 98 has a geared end 99. Likewise link 102 has a geared end 103. Geared ends 99 and 103 are of equal diameters and are engaged with one another. Similarly, links 104 and 114 are each pivotally attached to common link 106 and have geared ends 105 and 115 respectively which are engaged with one another. Similarly, links 112 and 122 are each pivotally attached to common link 116 and have geared ends 113 and 123 respectively which are engaged with one another.

Figure 19:
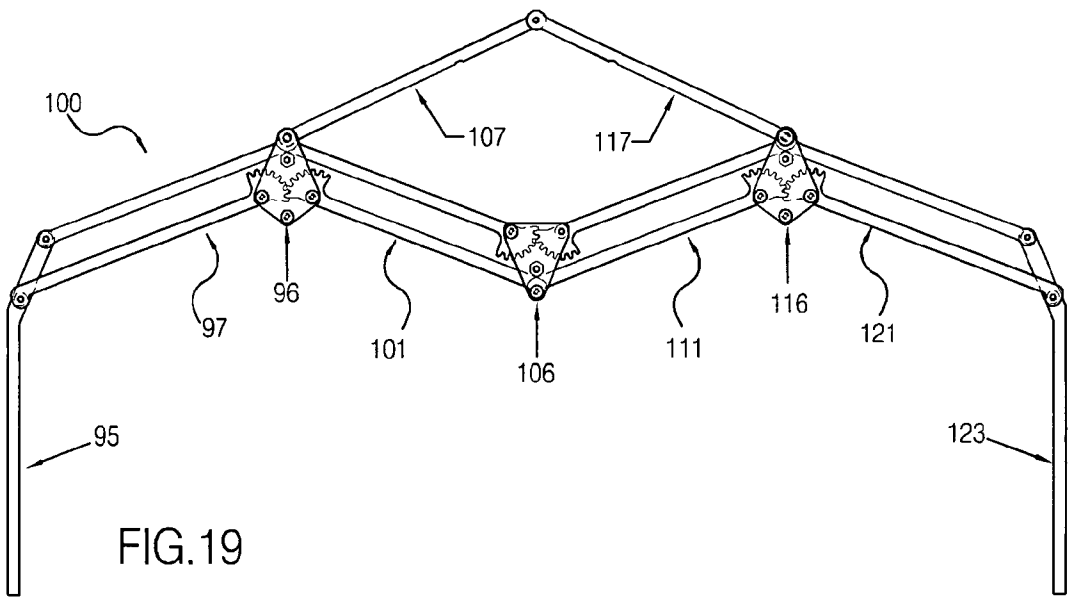
FIG. 19 is a front elevational view that shows the linkage mechanism of FIG. 17 in a fully opened condition.

FIG. 19 shows mechanism 100 in a fully opened condition. It may be seen that links 95 and 123 serve as support legs to the structure.

Figure 20:
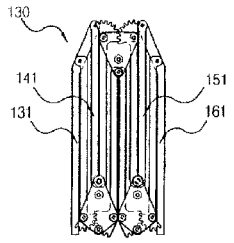
FIG. 20 is a front elevational view that shows a seventh embodiment of the inventive linkage mechanism.

FIG. 20 shows a mechanism 130 which is comprised of four linkages 131, 141, 151 and 161 in its folded condition.

Figure 21:
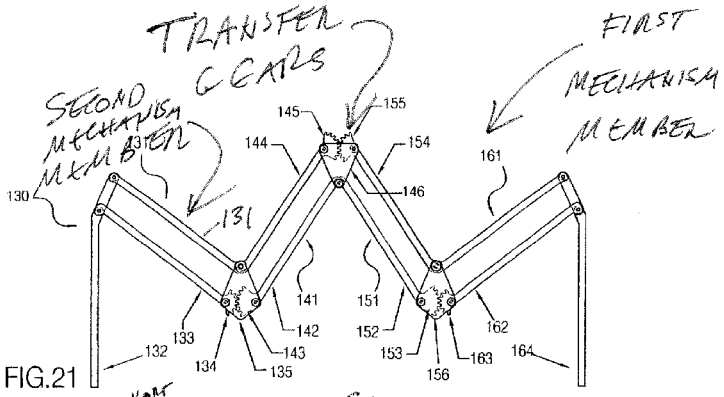
FIG. 21 is a front elevational view that shows the linkage mechanism of FIG. 20 in a partially opened condition.

FIG. 21 shows mechanism 130 in a partially opened condition. Linkages 131 and 141 share a common link 135. Linkages 141 and 151 share a common link 146. Linkages 151 and 161 share a common link 156. Links 132 and 164 have extended lengths.

Links 133 and 142 are pivotally attached to common link 135. Link 133 has a geared end 134. Likewise link 142 has a geared end 143. Gears 134 and 143 are of unequal diameters and are engaged with one another. Similarly, links 144 and 154 are each pivotally attached to common link 146 and have geared ends 145 and 155 respectively which are engaged with one another. Gears 145 and 155 are of equal diameters.

Similarly, links 152 and 162 are each pivotally attached to common link 156 and have geared ends 153 and 163 respectively which are engaged with one another. Gears 153 and 163 are of unequal diameters.

Figure 22:
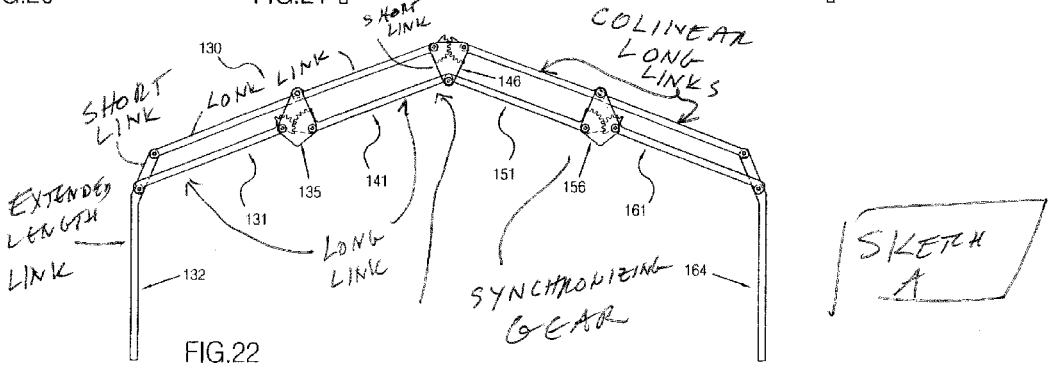
FIG. 22 is a front elevational view that shows the linkage mechanism of FIG. 20 in a fully opened condition.

FIG. 22 shows mechanism 130 in a fully opened condition. It may be seen that links 132 and 164 serve as support legs to the structure. Further, it may be seen that linkages 131 and 141 have a sloped orientation in one direction, whereas linkages 151 and 161 have a sloped orientation in the opposite direction, thereby forming a peaked roof shape for mechanism 130.

Figure 23:
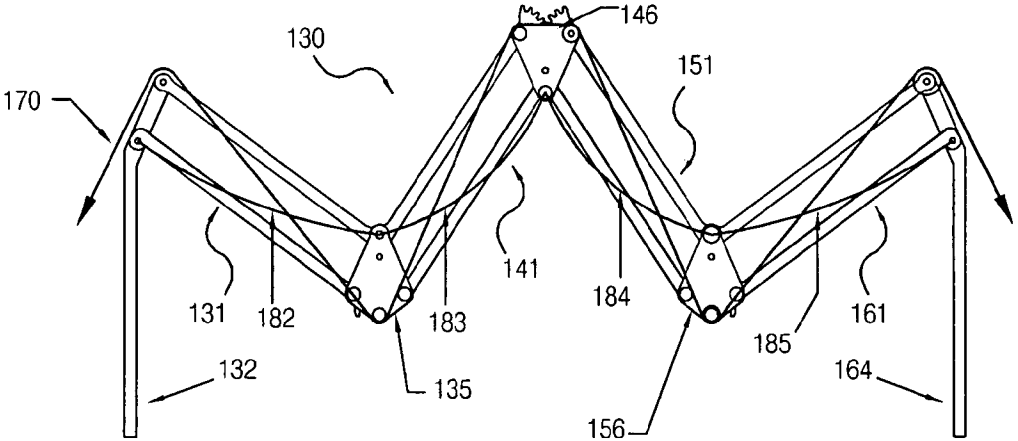
FIG. 23 is a front elevational view that shows a series of cables attached to the linkage mechanism of FIG. 20 in a partially opened condition.

In FIG. 23, a series of cables are shown attached to mechanism 130, which is in a partially opened condition. A cable 170 is shown routed through mechanism 130 such that it passes around one end of extended link 132, to common link 135, to common link 146, to common link 156 and finally around one end of extended link 164. By pulling on each end of cable 170, a force is applied to mechanism 130 which causes it to open. Also attached to mechanism 130 are four cables 182, 183, 184 and 185 which are in a slack condition. Cable 182 terminates on extended link 132 and common link 135. Cable 183 terminates on common link 135 and common link 146. Cable 184 terminates on common link 146 and common link 156. Cable 185 terminates common link 156 and on extended link 164.

Figure 24:
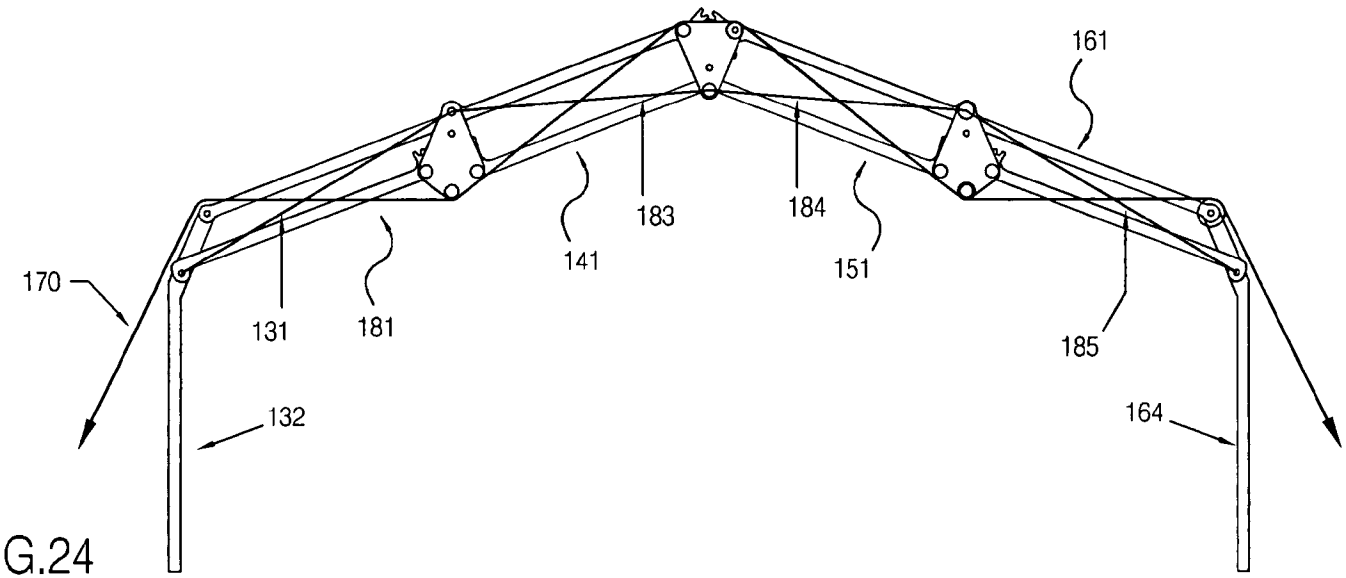
FIG. 24 is a front elevational view that shows the linkage mechanism of FIG. 20 in a fully opened condition with the series of cables shown in FIG. 23 in a straight and taut condition.

FIG. 24 shows mechanism 130 in a fully opened condition. Cables 182, 183, 184 and 185 are seen to be in a straight and taut condition. Linkage 131 is crossed by two diagonal cables 181 and 170. Likewise, linkage 141 is crossed by cables 182 and 170. Linkages 151 and 161 are crossed by cables 183, 170 and 184, 170 respectively. Cable 170 may be fixedly attached at its two ends to extended links 132 and 164. When cable 170 is so attached, mechanism 130 takes the condition of a structural truss with linkages 131, 141, 151 and 161 providing compressive members and cables 170, 181, 182, 183, and 184 providing diagonal tension members.

Figures 25, 26, 27, 28:
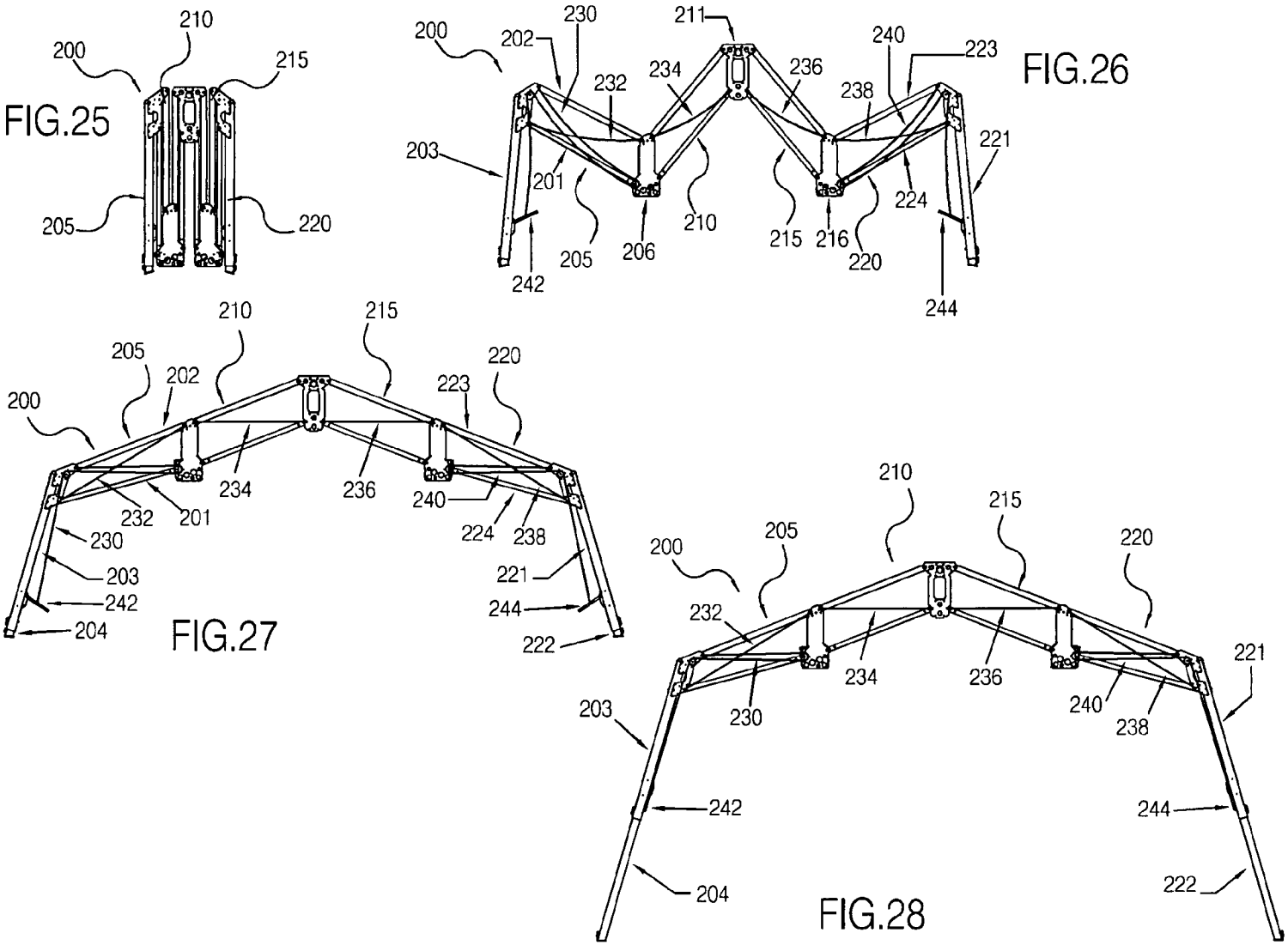
FIG. 25 is a front elevational view that shows an eighth embodiment of the invention linkage mechanism in a fully closed condition.
FIG. 26 is a front elevational view of the linkage mechanism of FIG. 25 in a partially opened condition.
FIG. 27 is a front elevational view that shows the linkage mechanism of FIG. 25 in a further opened condition.
FIG. 28 is a front elevational view that shows the linkage mechanism of FIG. 25 in its fully opened condition.

FIG. 25 shows a mechanism 200 comprised of four linkages 205, 210, 215 and 220 in a fully closed condition.

FIG. 26 shows mechanism 200 in a partially opened condition. Linkage 205 is comprised of four links 201, 202, 203 and 206. Linkage 205 is crossed by two cables 230 and 232. Cable 230 terminates at one point on link 203, routs around pulley connections at links 206 and 203 respectively, and finally terminates at link 242, which is pivotally connected to link 203. Linkages 210 and 215 are crossed by cables 234 and 236 respectively. Linkage 220 is crossed by cable 240 which routs around links 221 and 216, finally terminating at link 244. Linkage 220 is further crossed by cable 238.

FIG. 27 shows mechanism 200 in a further opened condition. Link 201 may be seen to be non-parallel with link 202. Similarly, link 223 may be seen to be non-parallel with link 224. Extended links 203 and 221 may be seen to have a splayed orientation, that is their relative distance is wider at the base than at the top of mechanism 200. This splayed orientation is a result of non-parallel links belonging to linkages 205 and 220.

Link 203 is an extended link and has a second member 204 which is retracted into link 203. Link 204 has a sliding connection with link 203. Link 221 is an extended link and has a second member 222, which is retracted into link 221. Link 222 has a sliding connection with link 221.

In FIG. 27, link 242 has been rotated relative to link 203. This rotation pulls cable 230 into a taut condition, thus providing an opening force for mechanism 200. Likewise, link 244 has been rotated, causing cable 240 to become taut.

FIG. 28 shows mechanism 200 in its fully opened condition. Link 204 is in an extended position from link 203. Link 222 is in an extended position from link 221. By extending links 204 and 222, mechanism 200 takes on a higher profile. Links 242 and 244 have been rotated fully such that they are now parallel with links 203 and 221 respectively. This fully rotated position of links 242 and 244 causes cables 230 and 240 to become fully taut, thus opening mechanism 200 to open completely. Cables 232, 234, 236 and 238 are also in a taut condition, thereby causing mechanism 200 to act as a fully structural truss.

Figure 29:
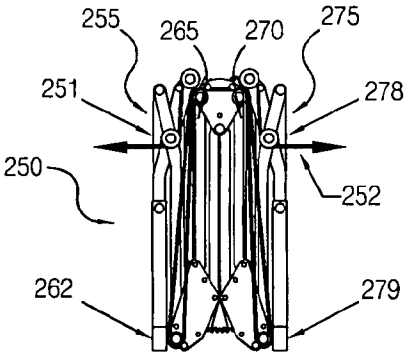
FIG. 29 is a front elevational view that shows a ninth embodiment of the inventive linkage mechanism.

FIG. 29 shows an alternate embodiment of the invention, namely mechanism 250, which is comprised of four linkages 255, 260, 265 and 270. Links 251 and 278, belonging to linkages 255 and 275 respectively, have attached to them sliding extensions 262 and 279 respectively, which are in a retracted position.

Figure 30:
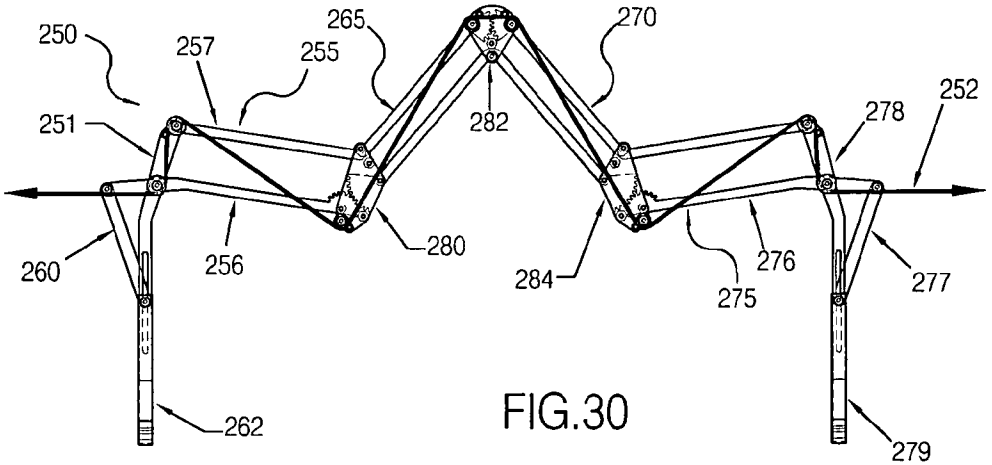
FIG. 30 is a front elevational view that shows the linkage mechanism of FIG. 29 in a partially opened condition.

FIG. 30 shows mechanism 250 in a partially opened condition. Linkage 255 is comprised of four links 251, 256, 280 and 257. Link 251 is an extended link. Link 262 extends further out of link 251, having a sliding connection to it. Link 256 has a link 260 which is pivotally attached to it. Link 260 is in turn pivotally attached to sliding extension 262.

In a symmetric manner to the above, link 278 is an extended link, having a further extension with link 279. Link 277 is pivotally attached to links 276 and extension 278.

Figure 31:
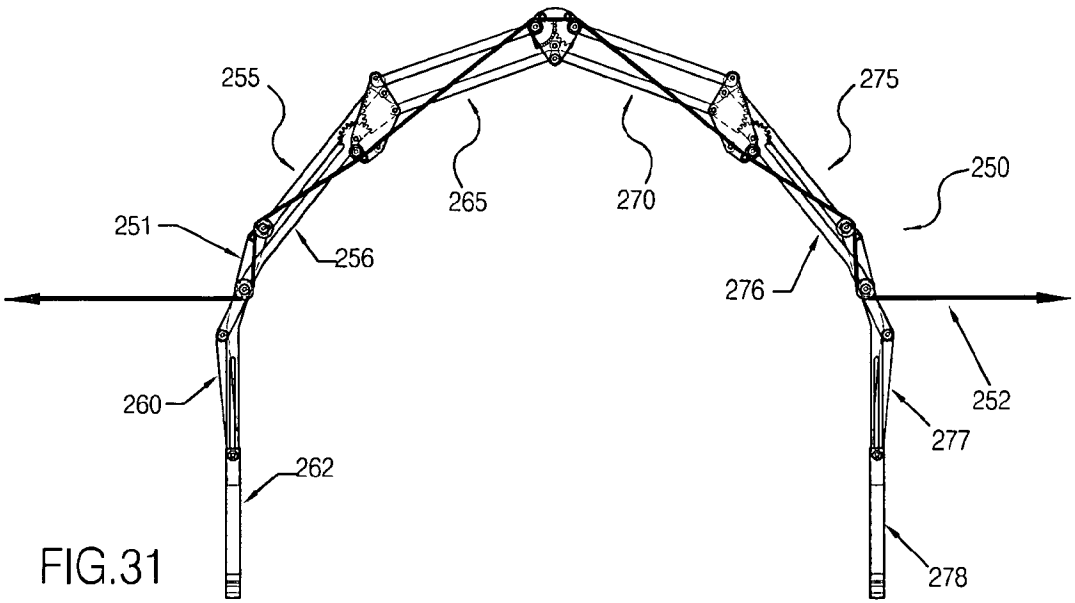
FIG. 31 is a front elevational view that shows the linkage mechanism of FIG. 29 in a fully deployed condition.

In FIG. 31, mechanism 250 is shown in a fully deployed condition. Link 260 has been driven by the relative rotation of link 256 to push link 262 into a fully extended condition. Likewise, link 277 has been driven by the relative rotation of link 276 to push link 278 into a fully extended condition.

FIG. 32 shows perspective view a structure 300 which is in a folded condition. and which is comprised of two mechanisms 301 and 302.

FIG. 33 shows a plan view of structure 300. Mechanisms 301 and 302 cross each other.

FIG. 34 shows structure 300 in a partially opened condition. Structure 300 is comprised of eight linkages 305, 310, 315, 320, 325, 330, 335 and 340. Linkages 305, 310, 315 and 320, belonging to mechanism 302, lie essentially in a common plane. Linkages 325, 330, 335 and 340, belonging to mechanism 301, also lie in a common plane which forms an angle to the plane of mechanism 302. Link 350 is a common link between linkages 310, 315, 330 and 335, and serves as a hub element connecting the linkages that lie in different planes. Structure 300 is supported by four extended links 309, 324, 329 and 344 which serve as supporting legs.

FIG. 35 shows a detailed view of hub element 350. Links 336 and 316 belonging to linkages 335 and 315 respectively have a bevel gear connection that synchronizes their relative movement.

FIG. 36 shows structure 300 in a fully opened condition. Links 306 and 311 form an essentially straight line. Likewise links 316, 321 and 336, 341 and 326, 331 form essentially straight lines all of which terminate in hub element 350.

FIG. 37 shows structure 300 in a partially opened condition with a fabric element 360 that is attached to it. Fabric element 360 is attached to structure 300 at nine points: hub element 350, links 307, 317, 332 and 337 and is also attached to the ends of links 309, 324, 329 and 344.

FIG. 38 shows structure 300 in a fully opened condition. Fabric element 360 is now held in a tensed and taut condition. In addition to its attachment to the nine elements already referred to, fabric element 360 is also attached along the straight lines formed by links 306,311 and 316, 321 and 336, 341 and 326,331 respectively.

FIG. 39 shows a plan view of structure 300 in a fully opened condition. Mechanisms 301 and 302 are capable of resisting the compressive force that fabric element 360 imparts. Fabric element 360, which is held in tension, ensures that the relative angle between mechanisms 301 and 302 is stable. Thus structure 300 acts as an integral structural system.

Figure 40:
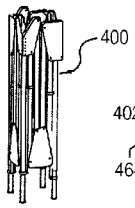
FIG. 40 is a perspective view of an alternative truss structure of the invention in a collapsed condition.

FIG. 40 shows a perspective view of structure 400 which is in a collapsed condition.

Figure 41:
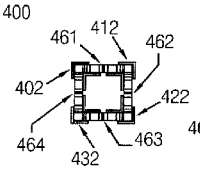
FIG. 41 is a plan view of the truss structure of FIG. 40.

FIG. 41 shows a plan view of structure 400 which is comprised of four mechanisms 461, 462, 463 and 464 each lying in different planes. Mechanism 461 is joined to mechanism 462 by hub element 412. Similarly, mechanism 462 is joined to mechanism 463 by hub element 422. Similarly, mechanisms 463 and 464 are joined to mechanisms 464 and 461 respectively by hub elements 432 and 402 respectively.

Figure 42:
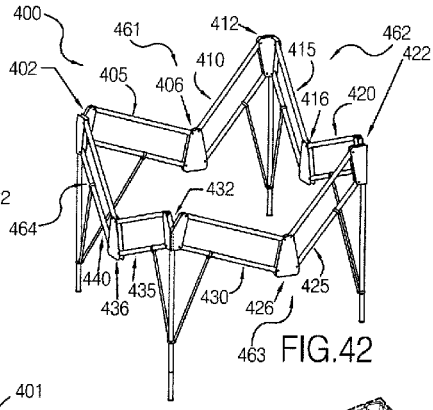
FIG. 42 is a perspective view that shows the truss structure of FIG. 40 in a partially opened condition.

FIG. 42 shows structure 400 in a partially opened condition. Mechanism 461 is comprised of linkages 405 and 410 which share a common link 406. Mechanism 462 is comprised of linkages 415 and 420 which share a common link 416. Mechanism 463 is comprised of linkages 425 and 430 which share a common link 426. Mechanism 464 is comprised of linkages 435 and 440 which share a common link 436.

Hub element 412, which joins linkages 410 and 415, contains within it mechanical means to synchronize the relative movement of the two linkages, said means being in the form of a geared connection. Hub elements 422, 432 and 402 also contain such a bevel gear connection.

Figure 43:
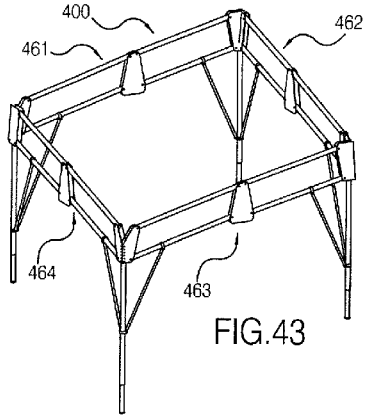
FIG. 43 is a perspective view of the truss structure of FIG. 40 in a fully opened condition.

FIG. 43 shows structure 400 in a fully opened condition wherein linkages 461, 462, 463 and 464 align along straight lines.

Figure 44:
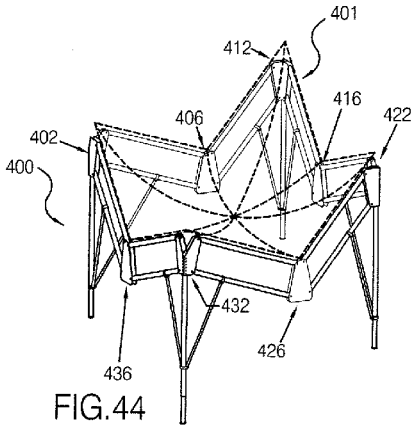
FIG. 44 is a perspective view that shows the truss structure of FIG. 40 in a partially opened condition whereby a fabric element has been attached.

FIG. 44 shows structure 400 in a partially opened condition whereby a fabric element 401 has been attached at eight places. These eight attachment places are hub elements 402, 412, 422 and 432 as well as common links 406, 416, 426 and 436.

Figure 45:
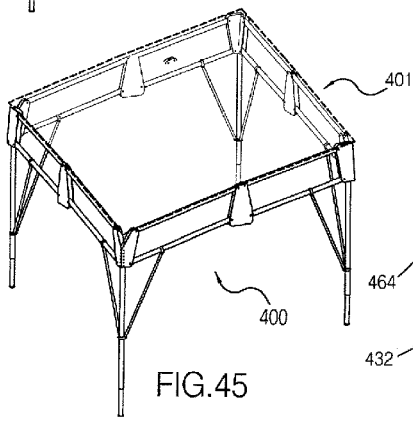
FIG. 45 is a perspective view of the truss structure of FIG. 40 in a fully opened condition with an attached fabric element.

FIG. 45 shows a perspective view of structure 400 in a fully opened condition with attached fabric element 401. Fabric element 401 is in a taut tensed condition.

Figure 46:
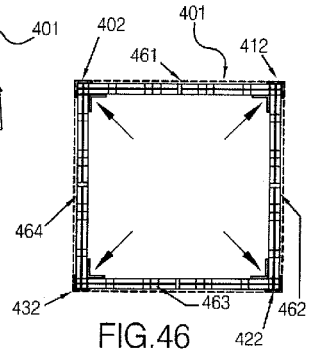
FIG. 46 is a plan view of the truss structure of FIG. 40 in a fully opened condition with an attached fabric element.

FIG. 46 shows a plan view of structure 400 in a fully opened condition with attached fabric element 401. It may be seen that mechanisms 461, 462, 463 and 464 serve as compressive elements which are stabilized against relative rotation by the tensed and taut fabric element 401. Thus, fabric element 401 serves as a tension element along with said compressive elements, thereby creating a stable and stiff structural system.

Figure 47:
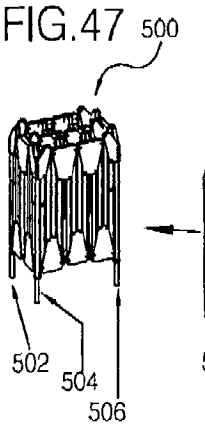
FIG. 47 is a perspective view of another truss structure of the invention in a collapsed condition.

FIG. 47 shows a perspective view of structure 500 in a collapsed condition.

Figure 48:
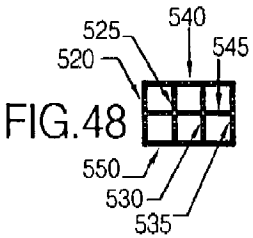
FIG. 48 is a plan view of the truss structure of FIG. 47 in a collapsed condition.

FIG. 48 shows a plan view of structure 500 in a collapsed condition. Structure 500 is comprised of seven mechanisms 520, 525, 530, 535, 540, 545 and 550.

Figure 49:
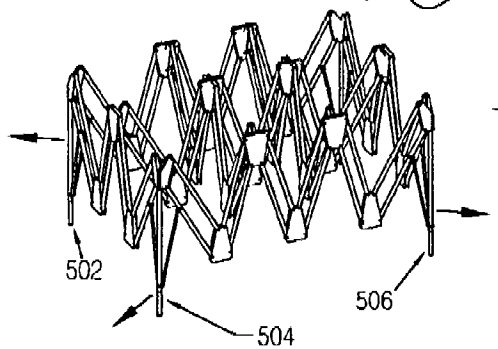
FIG. 49 is a perspective view that shows the truss structure of FIG. 47 in a partially opened condition.

FIG. 49 shows structure 500 in a partially opened condition. Leg elements 502, 504, 506 and 508 support structure 500. Directional arrows 503, 505, 507 and 509 indicate the forces that are applied to the leg elements that open structure 500. Structure 500 may be seen to have a stable and upright condition during its opening.

Figure 50:
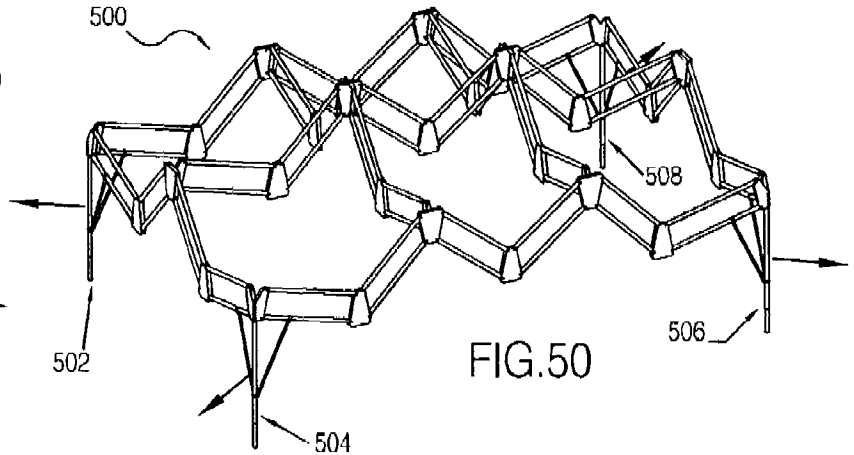
FIG. 50 is a perspective view that shows the truss structure of FIG. 47 in a further opened condition.

FIG. 50 shows structure 500 in a further opened condition. Directional arrows 513, 515, 517 and 519 again indicate the force required to open structure 500 which remains in a stable and upright condition.

Figure 51:
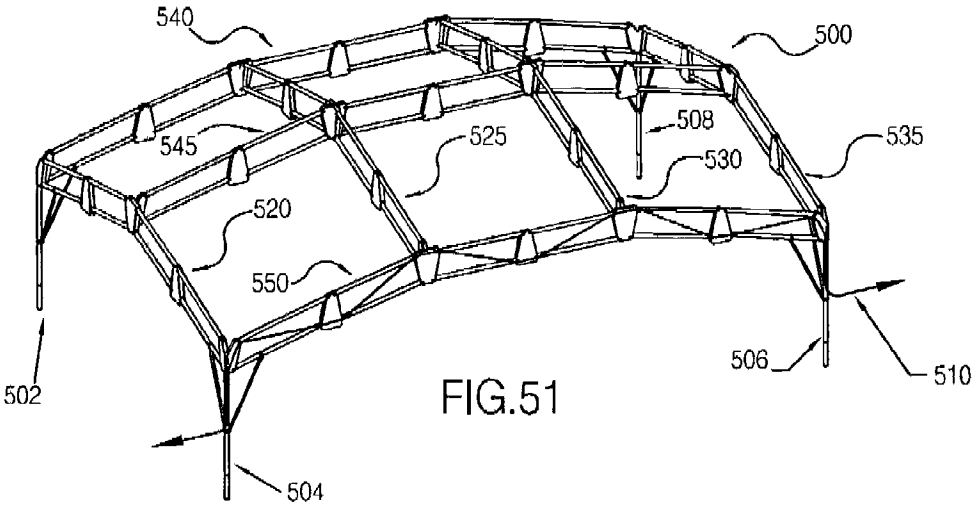
FIG. 51 is a perspective view that shows the truss structure of FIG. 47 in a fully opened condition.

FIG. 51 shows structure 500 in a fully opened condition. Mechanisms 520, 525, 530, 535, 540, 545 and 550 have a smooth structural profile in this condition. Cable element 510 is shown providing the force to fully open structure 500. This cable force is required to fully open structure 500 because simply applying an outward force to the leg elements will not in itself raise the mechanisms into their fully opened condition. It may be seen that structure 500 forms a doubly curved shape.

Figure 52:
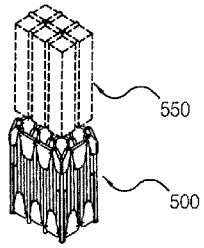
FIG. 52 is a perspective view that shows still another truss structure of the invention in a collapsed condition with an attached fabric element.

FIG. 52 shows structure 500 in a collapsed condition with a fabric element 550. Fabric element 550 is shown in exploded view relative to structure 500, thus indicating that the fabric will nest directly within collapsed structure.

Figure 53:
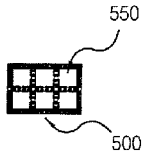
FIG. 53 is a plan view of the truss structure of FIG. 52 collapsed.

FIG. 53 shows a plan view of collapsed structure 500 with fabric element 550 nesting directly into the open space of the structure.

Figure 54:
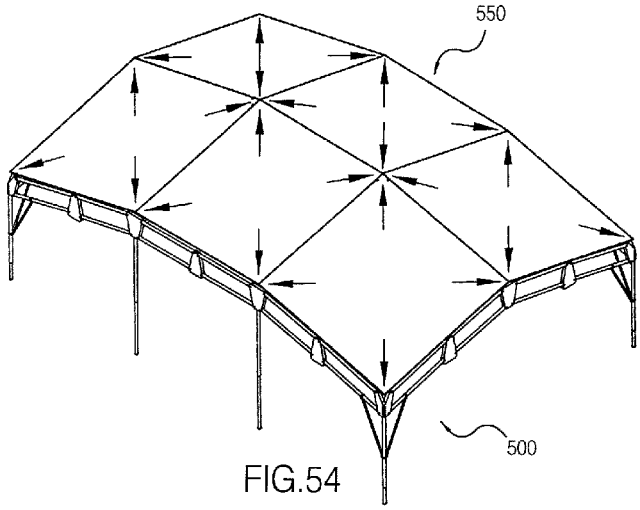
FIG. 54 is a perspective view that shows the truss structure of FIG. 52 in a fully opened condition.

FIG. 54 shows structure 500 in a fully opened condition. Fabric element 550 is taut, thus providing a tension element that acts to form a full structural system with structure 500.

Figure 55:
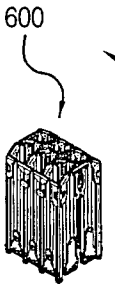
FIG. 55 is a perspective view that shows yet a further truss structure in a fully collapsed condition.

FIG. 55 shows a structure 600 in a fully collapsed condition.

Figure 56:
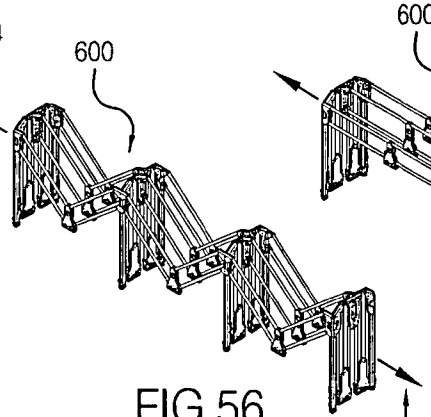
FIG. 56 is a perspective view that shows the truss structure of FIG. 55 in a partially expanded condition.

FIG. 56 shows structure 600 in a partially expanded condition. Directional arrows 602 and 604 indicate that structure 600 is being extended in length although it remains fully collapsed in width.

Figure 57:
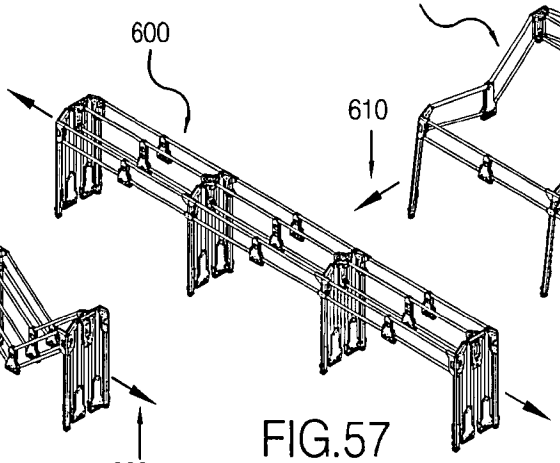
FIG. 57 is a perspective view that shows the truss structure of FIG. 55 in a further expanded condition.

FIG. 57 shows structure 600 in a further expanded condition, now having been fully extended in length although remaining fully collapsed in width.

Figure 58:
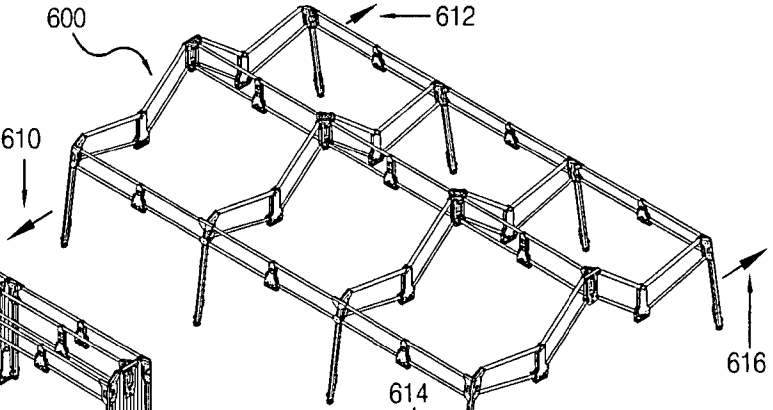
FIG. 58 is a perspective view that shows the truss structure of FIG. 55 in yet a further expanded condition.

FIG. 58 shows structure 600 in a further expanded condition where directional arrows 610, 612, 614 and 616 indicate that structure 600 is being extended in width.

Figure 59:
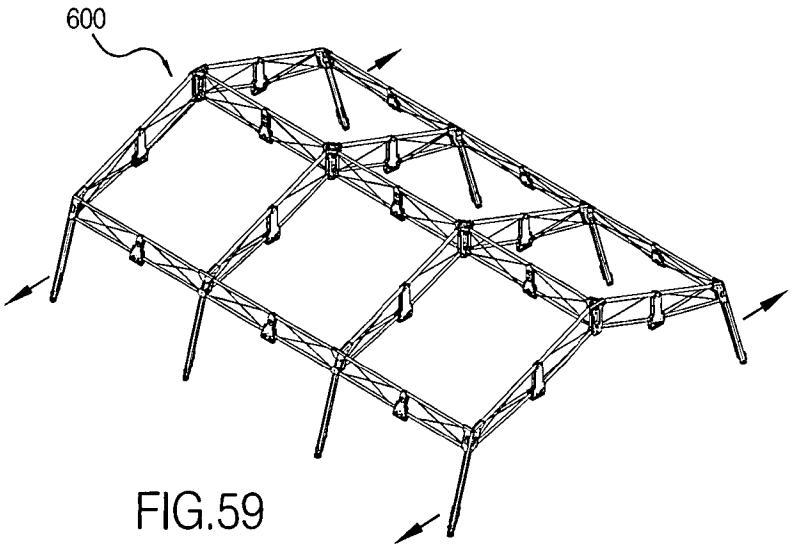
FIG. 59 is a perspective view that shows the truss structure of FIG. 55 fully extended in both length and width.

FIG. 59 shows structure 600 having now been fully extended in both length and width.

Figure 60:
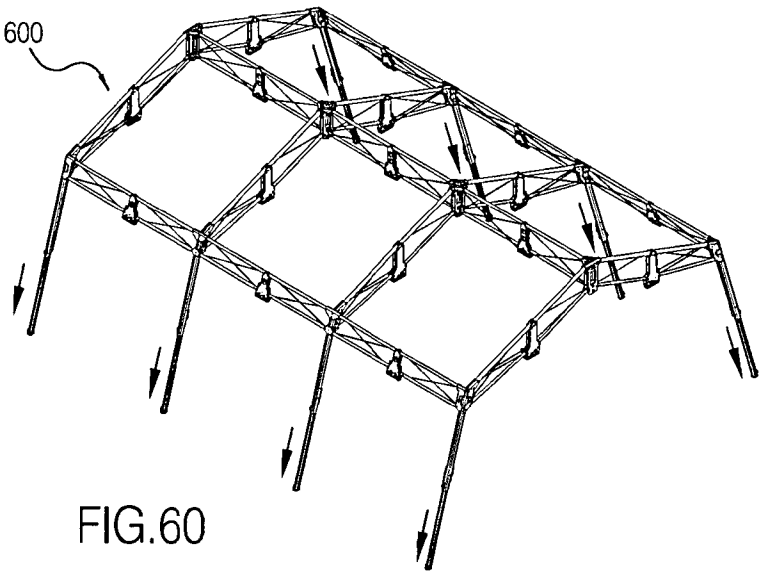
FIG. 60 is a perspective view that shows the truss structure of FIG. 55 with its legs extended.

FIG. 60 shows structure 600 with its legs being extended, it now being in a fully opened condition.

Figures 61, 62, 63, 64:
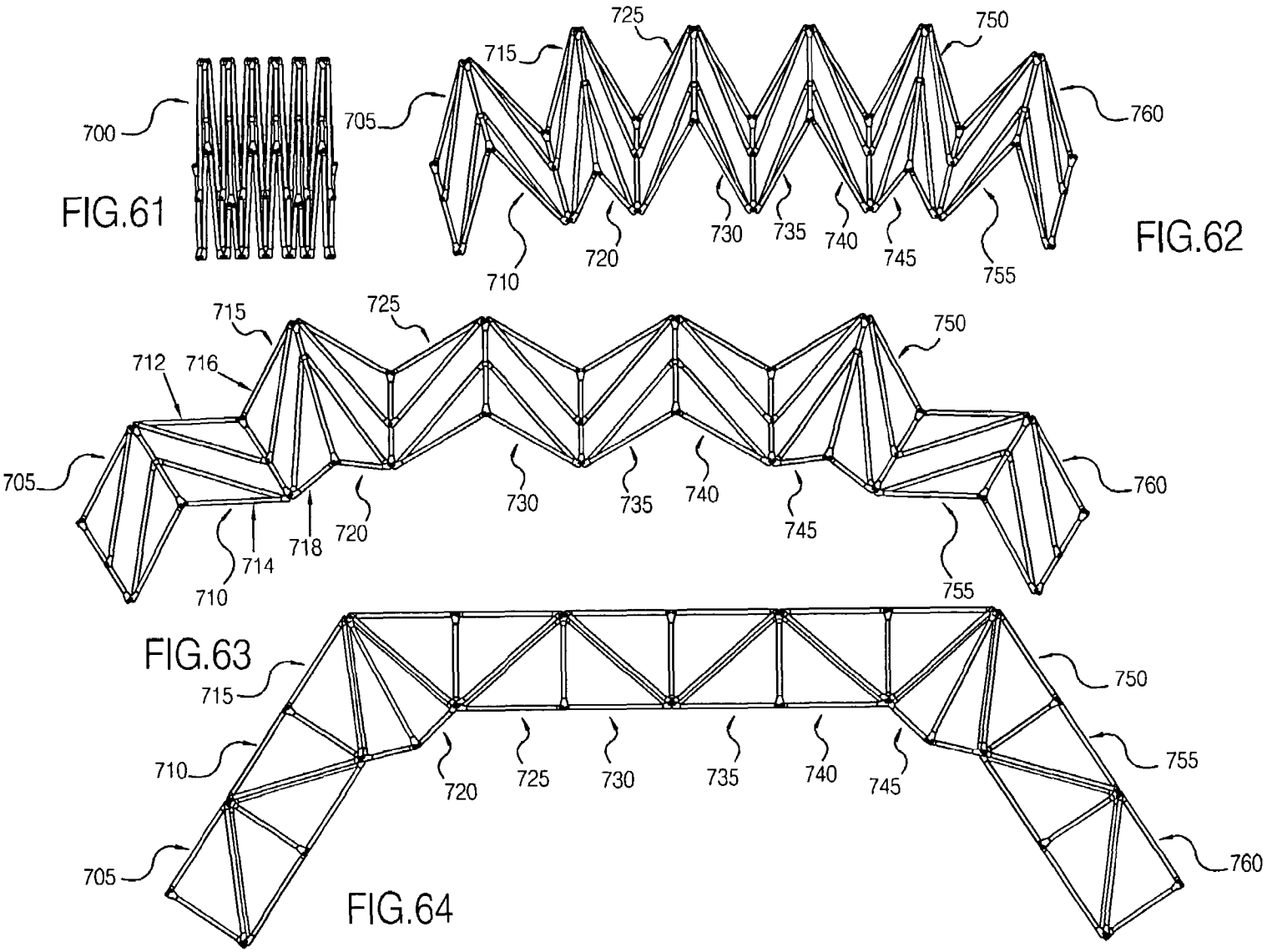
FIG. 61 is a front elevational view of yet another embodiment of the inventive linkage mechanism.
FIG. 62 is a front elevational view of the linkage mechanism of FIG. 61 in a partially expanded condition.
FIG. 63 is a front elevational view that shows the linkage mechanism of FIG. 61 in a further expanded condition.
FIG. 64 is a front elevational view that shows the linkage mechanism of FIG. 61 in a fully expanded condition.

FIG. 61 shows an alternate embodiment of the invention, namely mechanism 700, which is in a collapsed condition.

FIG. 62 shows mechanism 700 in a partially expanded condition. Mechanism 700 is comprised of twelve linkages 705, 710, 715, 720, 725, 730, 735, 740, 745, 750, 755 and 760, which twelve linkages are essentially similar in function to linkages 71, 78, and 84 shown in FIG. 14.

FIG. 63 shows mechanism 700 in a further expanded condition. Links 714 and 712 belonging to linkage 710 are parallel. Likewise, links belonging to linkages 705, 725, 730, 735, 740, 755 and 760 are parallel in a similar fashion. Linkages 716 and 718 belonging to linkage 715 are not parallel to each other. Likewise, links belonging to linkages 720, 745 and 750 are non-parallel in a similar fashion.

FIG. 64 shows mechanism 700 in a fully expanded condition forming a fully structural truss.

Figure 65:
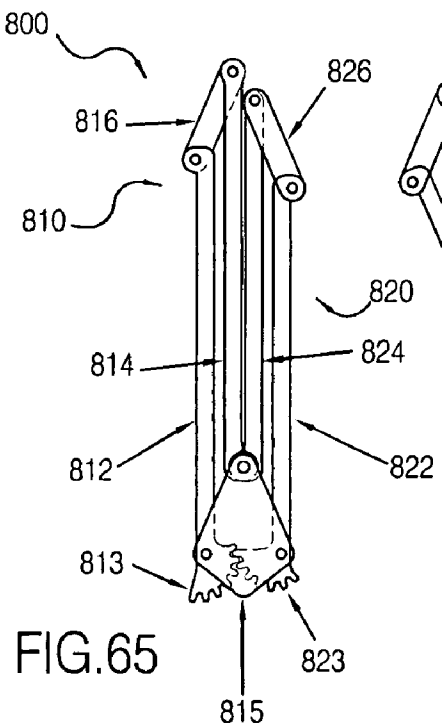
FIG. 65 is a front elevational view of yet another alternate embodiment of the inventive linkage mechanism.

FIG. 65 shows a mechanism 800 which is comprised of two linkages 810 and 820 sharing a common link 815. Linkage 810 is comprised of four links 812, 814, 816 and 815. Linkage 820 is comprised of four links 822, 824, 826 and 815. Link 812 terminates in gear end 813. Link 822 terminates in gear end 823. Link 814 may be seen to be essentially parallel with link 824. Gears 813 and 823 have non-constant radii, being essentially elliptical in shape.

FIG. 65 shows mechanism 800 whereby linkages 810 and 820 have been rotated to a different position. Links 814 and 824 form angles 830 and 840 with the center line of common link 815. The movement of linkages 810 and 820 is synchronized by the engagement of gears 813 and 823.

Figure 67:
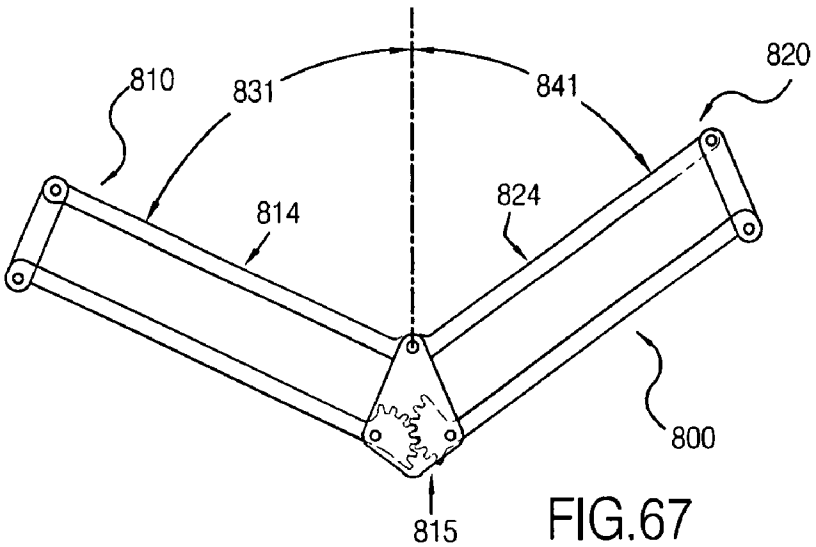
FIG. 67 is a front elevational view that shows the linkage mechanism of FIG. 65 in a third position.
Figure 66:
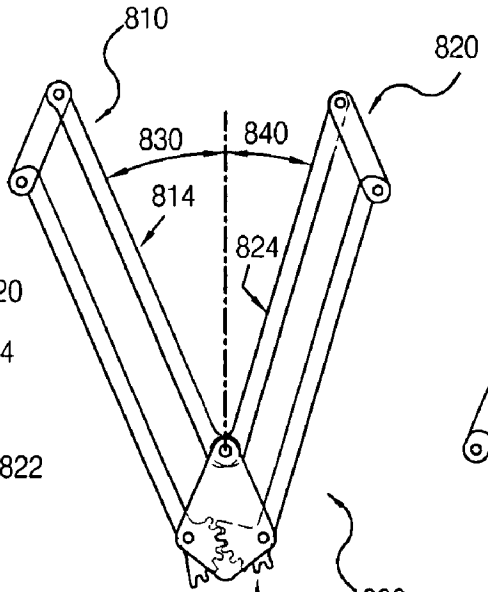
FIG. 66 is a front elevational view of the FIG. 65 linkage mechanism whereby the linkages have been rotated to a different position.
Figure 68:
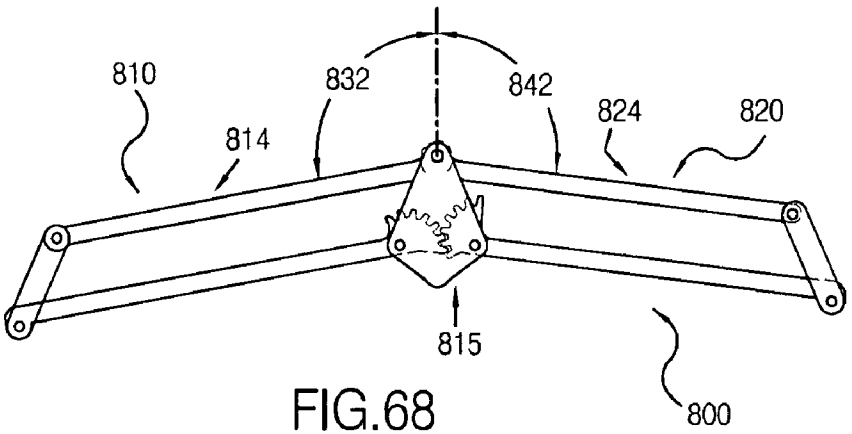
FIG. 68 is a front elevational view that shows the linkage mechanism of FIG. 65 in a fourth position.

FIGS. 67 and 68 show linkages 810 and 820 having been rotated to two successive positions. Links 814 and 824 form respectively angles 831, 832 and 841, 842 as mechanism 800 is successively rotated.

As mechanism 800 is rotated, the ratio between the angle formed by link 814 and the centerline of hub 815, to that angle formed by link 824 and the centerline of hub 815, is non-constant due to the changing radii of gear ends 813 and 823.

The scope of the invention will now be indicted in the following claims.

The invention claimed is:

1. A mechanism for supporting a temporary building structure comprising:

a first, a second, a third and a fourth linkage, each said linkages being four-bar linkages consisting of two opposed short links and two opposed long links, said short and long links being pivotably interconnected, each linkage being adjacent to at least one other linkage, all adjacent linkages having a common short link, each linkage including a gear intermeshed with the gear of the adjacent linkage;

wherein said linkages are arranged to define a folded condition wherein all the opposed long links of the linkages are substantially in parallel and in close proximity to each other; and wherein said linkages are pivoted from said folded condition to a fully opened condition in which said first and said second linkages have a sloped orientation in one direction and said third and fourth linkages have a sloped orientation in the opposite direction to form a peaked roof shape for the mechanism.

2. The mechanism of claim 1 wherein in said fully opened condition one long link of said first linkage is substantially collinear with a corresponding long link of said second linkage.

3. The mechanism of claim 1 wherein the intermeshed gears of said first and said second linkages have unequal diameters.

4. The mechanism of claim 1 wherein the intermeshed gears between said second and said third linkage have equal diameters.

5. The mechanism of claim 1 wherein each linkage includes a cable, said cables limiting the pivoting of said linkages when said fully opened condition is reached.

6. The mechanism of claim 5 wherein the links of said linkages have link ends joined at pivoting points, wherein said cable has cable ends attached to said link ends.

7. The mechanism of claim 5 wherein said cables and said linkages cooperate to form a structural truss with compressive members and tension members, with said linkages providing the compressive members and the cables providing the tension members.

8. The mechanism of structure of claim 1 wherein in each linkage each link has link ends with the link ends of each short link being attached to the link end of the long links at respective pivoting points to form four sided polygons and wherein each linkage further comprises a first cable attached to two opposed pivoting points, said first cable becoming straight and taut when each said linkage reaches said fully open position.

9. The mechanism of claim 8 wherein each linkage further includes a second cable connected to other opposed pivoting points.

10. A mechanism for supporting a structure comprising:

a first mechanism member and a second mechanism member, each mechanism member including a first linkage formed of two long links, a short link and an extended length link having a link portion opposite said short link, said linkages being connected at four pivoting points; each mechanism member including a second linkage including a two long links, a first short link, and a second short link, said second short link being shared as the short link of said first linkage and said first short link being shared as the first short link of the second linkage of the second mechanism member; each first mechanism member including a synchronizing member formed of a first synchronizing gear attached to said first linkage and a second synchronizing gear attached to said second linkage, said first and second synchronizing gears being intermeshed and having unequal diameters selected to allow said first and second mechanism members to be pivoted into a folded condition wherein said long links and said extended length link are all disposed in parallel and in close proximity to each other; and wherein said first and second mechanism members cooperate to extend into a fully opened condition in which the linkages of said first mechanism member have a sloped orientation in one direction whereas the linkages of said second members have a sloped orientation in the opposite direction to form a peaked roof shape for the mechanism, with said extended length links forming support legs for the structure.

11. The mechanism of claim 10 wherein in said fully opened condition one long link of said first linkage is substantially collinear with a corresponding long link of said second linkage.

12. The mechanism of claim 10 further comprising a transfer member for transferring motion between said first and second mechanism members and including a first transfer gear attached to said first mechanism member and a second transfer gear attached to said second mechanism member and intermeshed with said first transfer gear, said transfer gears having equal diameters.

13. The mechanism of claim 12 wherein each linkage includes a cable, said cables limiting the pivoting of said linkages when said fully opened condition is reached.

14. The mechanism of claim 13 wherein the links of said linkages have link ends joined at pivoting points, wherein said cable has cable ends attached to said link ends.

15. The mechanism of claim 13 wherein said cables and said linkages cooperate to form a structural truss with compressive members and tension members, with said linkages providing the compressive members and the cables providing the tension members.

16. The mechanism of structure of claim 12 wherein in each linkage each link has link ends with the link ends of each short fink being attached to the link end of the long links at respective pivoting points to form four sided polygons and wherein each linkage further comprises a first cable attached to two opposed pivoting points, said first cable becoming straight and taut when each said linkage reaches said fully open position.

17. The mechanism of claim 16 wherein each linkage further includes a second cable connected to other opposed pivoting points.

* * * * *